United States Patent [19]

Wendt

[11] 4,255,910

[45] Mar. 17, 1981

[54] ACCESSIBLE PARTITION ASSEMBLY

[75] Inventor: Alan C. Wendt, Barrington, Ill.

[73] Assignee: United States Gypsum Company, Chicago, Ill.

[21] Appl. No.: 93,426

[22] Filed: Nov. 13, 1979

[51] Int. Cl.[3] ..... E04B 2/60; E04B 2/78

[52] U.S. Cl. ..... 52/481; 52/489

[58] Field of Search ..... 52/481, 483, 489, 354, 52/361

[56] References Cited

U.S. PATENT DOCUMENTS

| | | | |
|---|---|---|---|
| 1,789,827 | 1/1931 | McKay | 52/481 X |
| 2,958,982 | 11/1960 | Baker | 52/481 X |
| 3,271,920 | 9/1966 | Downing, Jr. | 52/481 X |
| 3,429,090 | 2/1969 | Metelnick | 52/481 |
| 3,900,996 | 8/1975 | Yoke | 52/489 X |
| 3,922,764 | 12/1975 | Downing, Jr. | 52/489 |
| 3,986,313 | 10/1976 | Nelsson | 52/481 |
| 3,998,018 | 12/1976 | Hodges | 52/489 X |
| 3,999,343 | 12/1976 | Roberts | 52/481 |
| 4,094,114 | 6/1978 | Burcham | 52/489 |
| 4,106,251 | 8/1978 | Nelsson | 52/765 |

FOREIGN PATENT DOCUMENTS

| | | | |
|---|---|---|---|
| 1034733 | 7/1978 | Canada | 52/489 |

*Primary Examiner*—Alfred C. Perham
*Attorney, Agent, or Firm*—Glenn W. Ohlson; Samuel Kurlandsky; Robert H. Robinson

[57] ABSTRACT

An accessible partition assembly is disclosed which comprises two opposed spaced-apart rows of panels, each panel having opposite vertical edges, and interior and exterior panel faces, adjacent panels meeting at joints in edge-to-edge relationship, a plurality of studs located intermediate said rows of panels, and positioned at joints between a pair of adjacent panels, panel and stud engageable means at each said joint, said engageable means comprising a first and second clip, each clip engaging a stud and one panel edge at a joint, whereby panels are demountably engaged to studs by means of a first clip engaged at one vertical edge and a second clip at the opposite vertical edge. An accessible partition assembly is also disclosed wherein alternate pairs of opposing corresponding panels are fixedly engaged and pairs of opposing corresponding panels therebetween are demountably engaged whereby fixed panels correspondingly oppose and demountable panels correspondingly oppose whereby fixed panels are engaged along both vertical edges by first clips and removable panels are engaged along both vertical edges by second clips. An accessible partition assembly wherein panels along one row are alternately fixedly engaged and demountably engaged and corresponding opposing panels along the other row are alternately demountably engaged and fixedly engaged wherein fixed panels oppose corresponding demountable panels.

44 Claims, 8 Drawing Figures

ACCESSIBLE PARTITION ASSEMBLY

BACKGROUND OF THE INVENTION (1) Field of the Invention

The invention relates to an accessible partition assembly comprising two opposed spaced-apart rows of panels having opposite vertical edges wherein adjacent panels meet at joints in edge-to-edge relationship and a plurality of studs are located intermediate said rows of panels positioned at joints between pairs of adjacent panels.

(2) Description of the Prior Art

Partition wall construction has evolved from the early stages of simply nailing or screwing wallboard panels to studs to sophisticated accessible and demountable systems widely used today. While many demountable assemblies exist, the concern of the industry is for versatility in a particular system whereby variable needs for accessibility can be accommodated by such assemblies without being limited to a single accessible formation.

Most accessible partition wall assemblies feature components which must be applied at every joint, thus limiting the systems versatility. For example, it is very common that presently used systems have every panel fully accessible by provision of releasable locking or snap engaging components. When such full accessibility is not desired these components must nonetheless be used at every joint. When a particular area of a panel assembly requires fixed mounting for additional stability or safety this option may be precluded. Additionally, if it would only be required to have alternate panels removable such prior systems again do not permit such opportunity.

Another important concern of the construction industry involves both the cost of installation and manufacture. When simple installation techniques are not facilitated, time can be wasted during installation. If positively locking components are not provided proper spacing at joints can be jeopardized. As difficult installation procedures are encountered the possibility of damage to wallboard panels, especially along marginal edges, increases. As particular edge configurations are required, as well as complex shapes for metal attachment artifices, the cost of manufacturing and the increased care required during shipping may be prohibitive.

It would accordingly be desirable to provide a partition wall assembly that affords versatility with regard to demountability as particular constructions require. It would additionally be beneficial to provide such a system wherein components are usable with conventionally edged wallboards, such as gypsum panels, and are positively locking providing accurate spacing with minimal installation time and damage to panels.

Such a system would also be more exceedingly usable if components are manufactured by conventional techniques and would not prohibitively exceed the cost of the more simple fixed panel partition assemblies wherein accessibility is not provided. Since conventional wallboard panels typically have simple flat square edges, slightly bevelled flat edges, or longitudinal kerfed edges, such a partition assembly would also be required to be fully compatible with these forms of panel edge configurations while yet attaining all the previously discussed sought-after properties.

(3) Objects of the Invention

It is an important object of the invention to provide an accessible partition assembly which may be provided either fully accessible or selectively accessible.

It is accordingly an object of the invention to provide a partition assembly which has components usable with fully accessible and selectively accessible partition constructions.

It is a further object of this invention to provide a snap-engaging clip for use with a snap-engageable stud which allows positive locking and accurate panel spacing.

It is an attendant object of the invention to provide a partition assembly wherein kerfed edge, simple bevelled, or square edge panels may be equally usable in a fully accessible or selectively accessible partition system.

It is another object of the invention to provide panel clips for use with a stud which allow snap-engagement at one side of the joint and fixed engagement at the other.

It is a related object of the invention to provide stud configurations featuring snap-engagement along ribbed portions and integral fixed engaging means along flange portions wherein single clip members are only required at each joint.

It is a concomitant object of the invention to provide a partion assembly which may be fully relocatable without damage to components.

SUMMARY OF THE INVENTION

All the objects and goals of the invention are attained with the present invention wherein an accessible partition assembly is provided having two opposed spaced-apart rows of panels, each panel having opposite vertical edges, and interior and exterior panel faces, wherein adjacent panels meet at joints in edge-to-edge relationship. Said assembly further having a plurality of studs located intermediate said rows of panels, positioned at joints between a pair of adjacent panels. Said studs comprising a web integrally interconnecting continuous vertical rib portions with flanges extending from each rib generally parallel planar with, and adjacent to, opposing interior panel faces. A panel and stud engageable means is additionally provided at each said joint wherein said engageable means comprises a first and second clip. Said first clip having an L-shaped edge-engaging portion and a stud flange-engageable portion wherein stud flanges are nested within a slot of said flange-engageable portion. The second clip has a generally L-shaped edge-engaging portion inserted into a panel edge and a resilient stud rib-enageable portion snap-engaging a stud rib. Whereby panels are demountably engaged to studs by means of a first clip engaged at one vertical edge and a second clip at the opposite vertical edge. The second clip is disengageable by moving a panel outward to disengage the resilient portion from the stud rib, and the first clip, at a joint at the opposite vertical panel edge, is disengageable by sliding the panel sideward to move the slot from nested engagement with the stud flange wherein panels are remountable by reversal of the demounting operation.

An accessible partition assembly is further provided wherein a plurality of generally C-shaped studs are located intermediate rows of panels and positioned at joints between a pair of adjacent panels wherein said studs alternately are positioned with adjacent studs having openings of the C-shape disposed in opposite directions. First and second clips provide panel and stud engageable means at each said joint wherein said first clip provides a stud flange-engageable portion for nesting engagement thereto and a second clip provides a resilient stud rib-engageable portion. Whereby said assembly has fixed panels engaged along vertical edges at said joints by said first clips and removable panels are engaged along vertical edges by second clips. The assembly thereby provides alternate pairs of opposing corresponding panels fixedly engaged and pairs of opposing corresponding panels therebetween demountably engaged by means of said alternating stud positioning. Opposite vertical edges of fixed panels are fixedly engaged to stud flanges by said first clips and opposite vertical edges of removable panels are removably engaged to stud rib portions by said second clips. The assembly provides accessibility along each panel row at said alternate removable panels.

An accessible partition assembly is further disclosed wherein studs are generally Z-shaped and are alternately positioned with adjacent studs disposed in 180° rotational relationship with adjacent studs in upside down orientation with respect to one another. The Z-shaped studs have continuous vertical rib portions and engageable flanges extending oppositely therefrom. A panel and stud engageable means is further provided comprising a first and second clip wherein said first clip engage edges of fixed panels to stud flanges and second clips engage edges of removable panels snap-engageably with said continuous vertical rib portions. Said assembly thereby providing panels along one row alternately fixedly and demountably engaged and opposing panels along the other row are alternately correspondingly demountably engaged and fixedly engaged. Fixed panels oppose corresponding demountable panels by means of said alternately positioned Z-shaped studs wherein the opposite vertical edges of fixed panels are fixedly engaged to opposing stud flanges by said first clips and opposite vertical edges of removable panels are demountably engaged to stud rib portions by said second clips. At each pair of corresponding opposing panels, one is removable and the other is fixed permitting accessibility alternately along said partition assembly from one row to the other row.

Further objects and aims of the invention are obtained by the provision of an accessible partition assembly wherein a plurality of channel-shaped studs are located intermediate rows of panels and positioned at joints between pairs of adjacent panels. The studs having a channel shape with kerf engaging means extending from arms thereof to insert within kerfed edge panels and additionally have continuous vertical rib portions for snap-engagement with clip members engaging adjacent kerfed panels. Said assembly is demountable at panel edges engaged by said clip.

Allied goals of the invention are also obtained by provision of an accessible partition assembly wherein a plurality of generally Z-shaped studs are provided. The studs have continuous vertical rib portions and kerf engaging means oppositely extending from flanges thereof to engage two kerfed edge panels. The assembly provides panel clips engaging two other panels at a joint in a resilient manner to the rib portions of the Z-shaped stud whereby demountability is provided at panel edges engaged by said clip by means of said resilient snap engagement to the stud rib portions.

DESCRIPTION OF THE PREFERRED EMBODIMENTS

Figure 1:
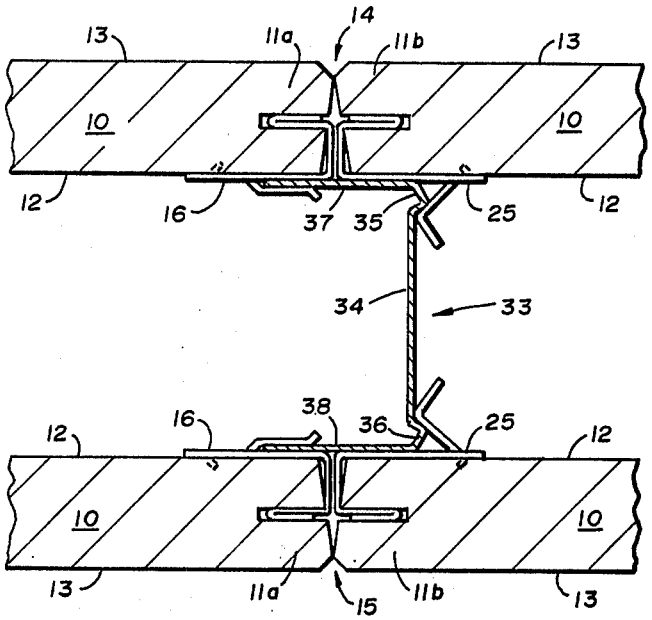
FIG. 1 is a cross sectional view of a typical stud and joint location in one embodiment of the partition assembly in accordance with this invention.

FIG. 1 shows a typical stud and joint location of the accessible partition assembly in a preferred embodiment of this invention wherein two opposed spaced apart rows of panels 10 are provided with kerfed edges **11*a* and 11*b*. Interior faces 12 oppose and exterior faces 13 provide the roomside decorative portion. Along one row adjacent panels 10 meet at joint 14 and at the opposite row panels 10 meet at joint 15. In this typical jointed alignment, kerfed edges 11*a* are engaged by first clips 16 and kerfed edges 11*b* are engaged by second clips 25. First clips 16 slidably engage later-described stud portions while clips 25 resiliently engage later-described stud portions. Clips 16 and 25 kerf engage panels 10 and engage studs 33. Studs 33 are located intermediate rows of panels and positioned at joints shown as joints 14 and 15 between pairs of adjacent panels 10. In this embodiment, stud 33 has web 34 integrally interconnecting continous vertical rib portions 35 and 36 at opposite rows. Flange 37 extends from rib 35 and flange 38 extends from rib 36 each flange generally parallel planar with, and adjacent to, opposing interior panel faces 12 and extend in generally the same direction to form the generally C-shape. At kerfed edges 11*a* clips 16 slidably engage flanges 37 and 38, and at kerfed edges 11*b* second clips 25 resiliently engage rib portions 35 and 36**.

Figure 2:
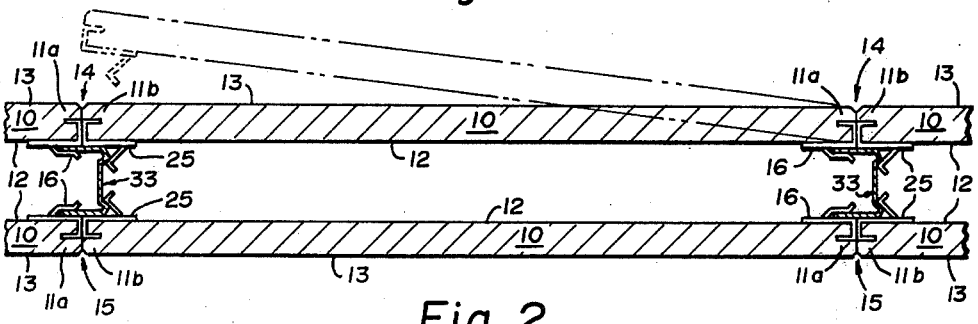
FIG. 2 is a cross sectional view of a portion of the wall partition assembly of the invention in one embodiment thereof having sequential studs illustrated, and in phantom, a demountable feature of the invention.

A demounting characteristic of the invention is graphically illustrated in FIG. 2 wherein, in phantom, a panel 10 is shown in position for resilient mounting. A sequence of panels 10 is shown with opposing interior faces 12 wherein along one row panels 10 meet at joints 14 and, along the opposite row, panels 10 meet at joints 15. Two sequential studs 33 are shown in substantially identical conformance with the embodiment of FIG. 1. In this alignment the openings of the C open in generally the same direction whereby, at kerfed edges 11*b*, second clips 25 engage panels 10 and, first clips 16 engage an adjacent panel 10 at kerfed edges 11*a*.

In the embodiment shown in FIG. 2, each panel 10 is demountably engaged. At edges 11*a* slidable engagement with flanges of stud 33 is obtained by first clips 16 and, at edges 11*b*, snap engagement with rib portions of stud 33 is obtained by means of second clip 25.

Figure 3:
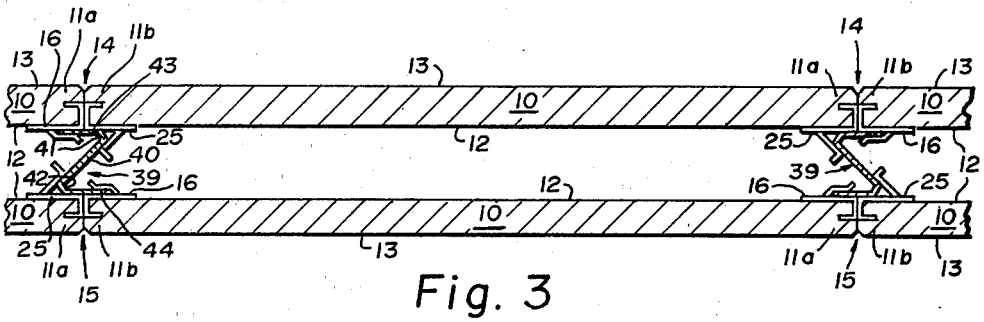
FIG. 3 is a cross sectional view of an alternate embodiment of the studs for the partition assembly of this invention showing sequential studs.

FIG. 3 illustrates a preferred alternate embodiment for stud configurations wherein stud 39 comprises a generally Z-shape and is interposed between rows of panels 10 at joints 14 and 15 formed by adjacent edge-to-edge panels 10. Stud 39 comprises a diagonal web 40 which integrally interconnects vertical rib portions 41 and 42. Extending from rib 41 is flange 43 and extending from rib 42 is flange 44. Flanges 43 and 44 are generally parallel planar with, and adjacent to, opposing interior panel faces 12 wherein flange 43 and flange 44 extend in opposite directions forming the Z-shape as shown. In this alignment, diagonally-related kerfed edges 11*a* and 11*b* are slidably engaged by first clips 16 by means of the reverse disposition of flanges 43 and 44. Accordingly with the diagonal relationship of ribs 41 and 42, the other diagonally-related kerfed edges 11*b* and 11*a* diagonally are engaged by second clips 25. The illustration of FIG. 3 shows Z-shaped studs 39 in 180° rotational relationship with adjacent studs in upside down orientation with respect to one another. This alignment disposes ribs 41 in opposing directions and flanges 44 in opposing directions. The configuration thus yields alternate panels along one row in a fixed and removable sequence wherein pairs of opposing corresponding panels between studs would opposingly be demountable and then fixed as shown. Another alternating alignment can be obtained with C-shaped studs 33 shown in FIG. 2. It would be an alternate embodiment to dispose adjacent studs 33 to have openings of the C in opposite directions. In this opposing relationship, both opposed panels 10 between two studs would both be fixed or both be removable. As would also be clear, when Z-shaped studs 39 are disposed in the same direction, all panels 10 would be demountable since adjacent stud rib portions 42 would oppose flanges 44 along one row and rib portions 41 would oppose flanges 43 along the other row. Therefore it is seen that at least four alternate combinations can be obtained for accessibility merely by utilizing the C-shaped studs 33 and Z-shaped studs 39 in the same orientation or in adjacent opposite alignment.

Figure 4:
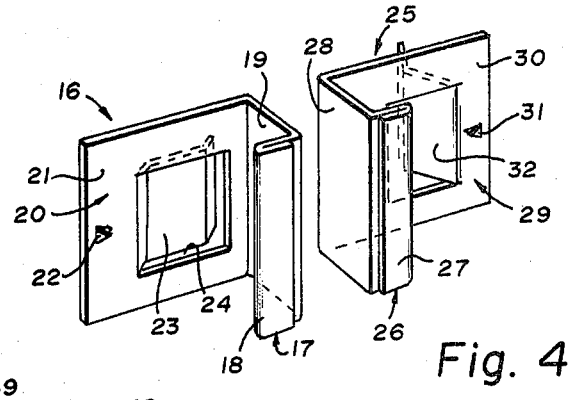
FIG. 4 is a perspective view of the stud and panel engageable means comprising a first and second clip in one embodiment of this invention.

The various demountable features of this inventive accessible partition assembly are particularly obtained by the provision of said first clips 16 and second clips 25, and are best illustrated in perspective as shown in FIG. 4. First clip 16 is comprised of an L-shaped edge engaging portion 17 and stud flange-engageable portion 20. L-shaped edge engaging portion 17 has a first leg 18 which is a kerf engaging portion for extension into kerfed edges 11*a* or 11*b* of panels 10 as illustrated in FIGS. 1–3. The first leg 18 terminates in a second leg 19 which is adapted to be disposed along the vertical edge 11*a* or 11*b* in a direction inward of said partion assembly. Second leg 19 is provided to terminate at an interior panel face 12 in stud flange-engageable portion 20. Stud flange-engageable portion 20 comprises a first plate 21 adapted for disposition along the interior panel face 12 and said portion 20 additionally comprises a bi-planar second plate 23 which is generally parallel planar with plate 21 and disposed inwardly to form a flange engageable slot 24 for enagement with stud flanges. First clip 16 is usable with panels 10 having opposite vertical edges 11*a* and 11*b* which are preferably beveled (as shown in FIG. 1) to gap open at the inward interior panel face 12 thereby allowing second legs 19 to be coactively disposed along edges 11*a* and 11*b* while providing at exterior faces 13 a single joint line without a gap, as is best illustrated in FIG. 1. It is also to be noted that plate 21 can be provided with a barb 22 extending in a direction toward, and slightly penetrating, interior panel faces 12 for additional retentive securement of first clip 16 if desired.

FIG. 4 additionally includes the preferred embodiment for second clip 25 which provides snap-engagement for panels to studs. Second clip 25 has an L-shaped edge-engaging portion 26 comprising a first leg 27, which is formed to be disposed and insertable within panel kerfs, such as kerfed edges 11*a* and 11*b*. First leg 27 and terminates at a second leg 28 formed to be disposed along the panel edges in a direction inward of said partition assembly. Second leg 28 terminates in a resilient stud rib-engageable portion 29. Resilient stud rib-engageable portion 29 comprises a plate 30 for coactive disposition along interior panel faces 12 in a direction substantially the same as first leg 27. Plate 30 may additionally have a barb 31 for additional penetrating affixation into interior panel faces 12 if desired. Plate 30 additionally comprises an integral resilient rib-engaging portion 32 for snap-engagement with rib portions of studs.

In the desirable embodiment for first clips 16 and second clips 25, shown in FIG. 4, second plate 23 of stud flange-engageable portion 20 and resilient rib-engaging portion 32 of resilient stud rib-engageable portion 29, are struck out from first plate 21 and plate 30, respectively. Thus an integral construction is obtained by means of a well known punching manufacturing procedure.

Figure 5:
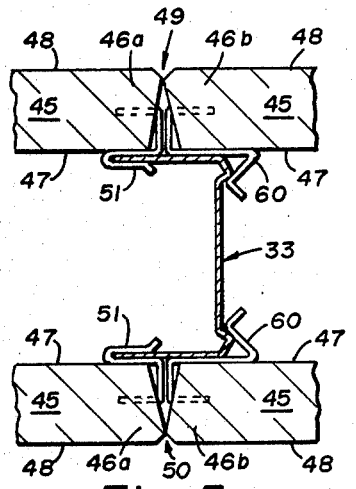
FIG. 5 is a cross sectional view of a typical stud and joint location in another embodiment of the partition assembly of this invention.

FIG. 5 shows a partition assembly wherein panels 45 are provided in two opposed spaced apart rows having opposite vertical edges 46*a* and 46*b* and interior surfaces 47 and exterior panel faces 48. Panels 45 along one row meet at joint 49 and panels 45 at the opposite row meet at joint 50. In this alignment opposite vertical edges 46*a* and 46*b* are not kerfed but rather have a simple flat bevelled edge, At said joints 49 and 50, stud 33, as previously described, is shown located intermediate rows of panels 45 at said joints between pairs of adjacent panels. To accomodate flat non-kerfed edges 46*a* and 46*b*, first clips 51 and second clips 60 are formed for impalement of said edges while yet attaining flange-engaging and rib-engaging affixation to studs 33.

Figure 6:
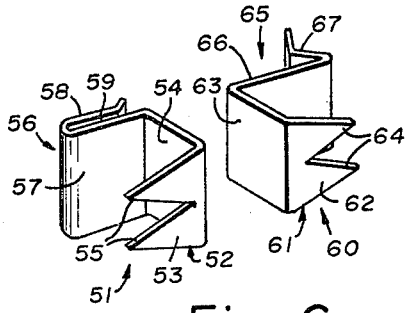
FIG. 6 shows in perspective view the stud and panel engageable means comprising two clips utilized in the embodiment of this invention as shown in FIG. 5.

In further conjunction with FIG. 5, reference is made to FIG. 6, wherein the preferred embodiment for first clip 51 and second clip 60 is shown. Both clips in this alternate embodiment are integral, and rather than having struck out portions as first clip 16 and second clip 25 have, the flange-engaging portion and rib-engaging portions are folded over. First clip 51 has L-shaped edge engaging portion 52 which comprises the first leg 53 for insertion into vertical edges 46*a* and 46*b*. This insertion into edges 46*a* and 46*b* is provided by impaling prongs 55 extending in co-planar relation from first leg 53. First leg 53 terminates distal of prongs 55 in a second leg 54 which is provided to be coactively disposed along panel edges in a direction inward of said partition assembly. Said second leg 54 terminates in a stud flange-engageable portion 56 which comprises first plate 57 for coactive disposition along interior panel faces 47 and a bi-planar second plate 58 in generally parallel planar relationship with first plate 57 and being integrally folded over from first plate 57, in a direction opposite first leg 53, to form a slot 59 for stud flange sliding engagement therebetween. Second clip 60 comprises an L-shaped edge-engaging portion 61 and resilient stud rib-engageable portion 65. L-shaped edge engaging portion 61 provides first leg 62 for insertion into panel edges by means of impaling prongs 64 extending in co-planar relation therefrom. First leg 62 terminates distal of prongs 64 in a second leg 63 which is provided to be coactively disposed along panel edges and extend inwardly of said partion assembly. Second leg 63 terminates at stud rib-engageable portion 65 at integral plate 66 which terminates in integral resilient rib-engaging portion 67. Rib engaging portion 67 provides snap-on engagement of panels to rib portions of studs such as ribs 35 and 36 of stud 33.

Figure 7:
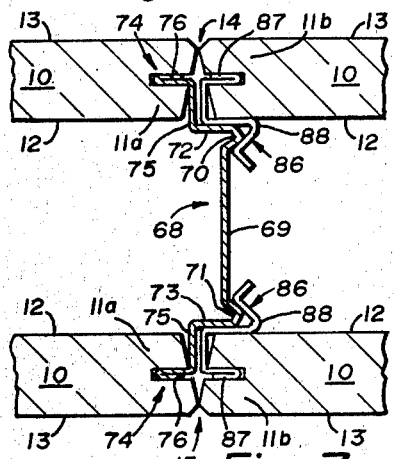
FIG. 7 is a cross sectional view illustrating a typical stud and joint location in conformance with one alternate embodiment of this invention utilizing studs having integral kerf engaging means thereon and a resilient clip snap-engaging stud rib portions and engaging kerfed panels.
Figure 8:
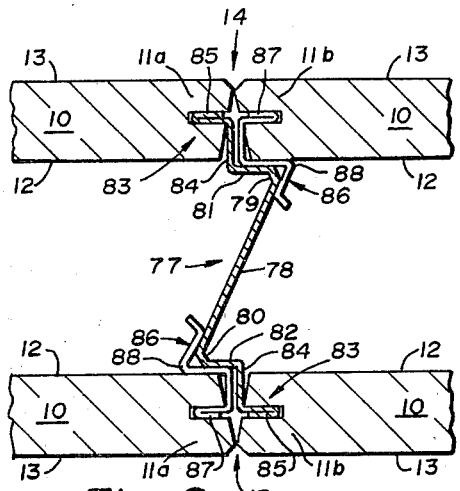
FIG. 8 is a cross sectional view of yet another embodiment of a stud and joint location for the partition assembly of this invention utilizing generally Z-shaped studs having integral kerf engaging means and rib portions engaged by snap-engageable clips which engage kerfed panels.

In addition to the embodiment shown in FIGS. 5 and 6, impaling prongs 55 and impaling prongs 64 may be provided for use with kerfed edge panels in attaining additional affixation to panel edges. Thus the embodiment of first clips 51 and second clips 60 would be equally usable with the alternate preferred embodiment shown in FIGS. 1–3 and the other alternate assemblies hereinbefore discussed. Moreover, with regard to FIG. 4, first leg 18 of first clip 16 could be provided with impaling prongs and first leg 27 of second clip 25 could also be provided with impaling prongs wherein the clips would still have a struck out manufacture whereby second plate 23 would be struck out from first plate 21 of first clip 16, and resilient rib-engaging portion 32 would be struck out from plate 30 of resilient second clip 25. Additionally, another configuration for a resilient rib-engaging clip may be provided such as second clip 86, as illustrated in FIGS. 7 and 8, which is provided with integral resilient rib-engaging portions 88, similar to portion 65 of second clip 60, while having kerf-engaging leg portion 87 simply inserted, with no impalement means, within kerfed eges 11*a* and 11*b* as illustrated. Such second clip 86, an alternate embodiment, would be substantially the same as second clip 60 shown in FIG. 6 absent impaling prongs 64 substantially the same as L-shaped edge-engaging portion 26 of second clip 25.

Additionally, with further regard to FIGS. 7 and 8, alternate preferred embodiments for studs are illustrated for attainment of the accessible and demountable objects of the invention.

FIG. 7 provides a generally channel-shaped stud 68 having a web 69 integrally interconnecting continuous vertical ribs 70 and 71. Arm 72 extends along interior panel faces 12 from rib 70 and arm 73 extends along the interior panel faces of panels 10 at the opposite row. Arm 72 and 73 extend in generally the same direction and are adjacent to, and in parallel relationship with, interior panel faces 12. At joints 14 and 15, arms 72 and 73 each terminate in kerf-engaging means 74. Kerf engaging means 74 are generally L-shaped and comprise first legs 75 disposed coactively along panel edges 11*a* in a direction outward of said partition assembly and said legs being integral, at the interior panel face 12, with arms 72 and 73. First legs 75 terminate at an opposite edge in integral second legs 76 which extend into kerfs at panel edges 11*a*. Thus kerf engaging means 74 provides the same general kerf engagement feature as would first clip 16 or first clip 51 by engaging within panel edges wherein panels 10 are demounted by sliding sideward away from studs 68 to disengage second leg 76. At adjacent panels 10, at panel edges 11*b*, second clips 86 are provided for resilient snap engagement with ribs 70 at joint 14, and ribs 71 at joint 15. As described, second clips 86 resiliently engage studs 68 to panels 10. In partition assemblies wherein channel shaped studs 68 are all provided with the openings of the channel in the same direction, every panel at both sides of the rows would be demountably engaged wherein disengagement of the second clips 86 would be provided by simple outward movement followed by disengagement with kerf engaging means 74 by a simple sideward sliding movement as stated. In alignments wherein channel shaped studs 68 are provided with adjacent studs in opposite directions wherein kerf engaging means 74 of adjacent studs would be oppositely disposed, alternate pairs of correspondingly opposed panels between joints would be alternately fixed and demountable with opposing pairs of panels alternately fixed and demountable.

FIG. 8 provides another alternate embodiment for a kerf-engaging stud configuration wherein a generally Z-shaped stud 77 is provided with a kerf engaging means 83 similar to channel-shaped stud 68. In this regard a diagonal web 78 integrally interconnects continuous vertical rib portions 79 and 80 at joints 14 and joints 15 respectively. Extending in opposite directions are arms 81 and 82 respectively extending from ribs 79 and 80. Arms 81 and 82 are adjacent to, and parallel with, interior panel faces 12 in similar relationship as arms 72 and 73 of channel shaped stud 68. Arms 81 and 82 terminate in integral kerf-engaging portions 83 having first legs 84 extending outwardly between adjacent panels at joints 14 and 15 and terminate in oppositely extending second legs 85 wherein diagonally related panels 10 on opposing rows at said joints are kerf-engaged thereby. The remaining two diagonally related panels at opposite sides of the joints 14 and 15 are snap-engaged with Z-shaped stud 77 by means of second clip 86 having the same configuration as shown in FIG. 7. Panels 10 are envisioned again as having kerfed edges 11*a* and 11*b* and second clip 86 has a non-impaling kerf engaging means 87 and resilient snap-engageable portion 88 for engagement with rib portion 79 at joint 14 and rib portion 80 at joint 15. In alignments wherein Zshaped studs 77 are provided in the same orientation, then all panels are demountable by means of first snap-disengaging second clips 86 followed by a sideward movement to disengage kerf engaging means 83 of stud 77 as previously described. In an alternate alignment, Z-shaped studs 77 may be provided wherein adjacent studs are in 180° rotational relationship with adjacent studs in upside down orientation with respect to one another, whereby in such alignment alternate panels along one row would be alternately fixed and demountable and corresponding opposing panels would alternately be demountable and fixed. In such a configuration, a fixed panel would oppose a demountable panel at each corresponding pair of opposing panels between studs.

It is thus seen that all the aims, objects and goals of the invention haeen obtained wherein accessibility is provided by means of a first and second clip having either impalement or simple kerf-engaging capability and wherein stud engagement is obtained at flanges and rib portions thereof. Additionally, alternate embodiments for stud configurations for utilization with alternate embodiments of first and second clips are also provided. With this invention, accessibility can be provided at every panel, at alternate panels along one row in correspondence with the other row, or alternte panels along one row can be fixed in correspondence with demountable panels at the opposing row. Installation steps are simplified by utilization of simple snap-engaging and panel edgeengaging means. Conventional manufacturing steps for the disclosed studs and clips can be utilized to obtain the shapes as herein described. Kerfed edges are not harmed during demounting and remounting since the snap-engagements and sliding engagements provide positive locking by simplified installation. First and second clips may be initially pre-installed along opposite vertical panel edges and retained in place by kerf engagement or impalement, thereby facilitating ease of installation and attachment to studs. When the studs provided have kerf engaging means, the second clips may similarly be preinstalled along panel edges thereby allowing for ease of sliding lockability along the kerf engaging means of the stud and inward movement to snap-engage second clips at the adjacent stud.

The preferred embodiment herein, with preferred alternate conformations as disclosed is presently considered to be the preferred form of the invention but changes and modifications may be made therein, and it is intended that the claims appended hereto shall cover such changes as found within the scope and spirit of this invention.

What is claimed is:

1. An accessible partition assembly comprising:

A. two opposed spaced-apart rows of panels, each panel having opposite vertical edges, and interior and exterior panel faces, adjacent panels meeting at joints in edge-to-edge relationship;

B. a plurality of studs located intermediate said rows of panels, and positioned at joints between a pair of adjacent panels, said studs comprising;

(1) a web integrally interconnecting, (2) continuous vertical rib portions, (3) a flange extending from each rib generally parallel planar with, and adjacent to, opposing interior panel faces; and, C. panel and stud engageable means at each said joint, said engageable means comprising a first and second clip, each clip engaging a stud and one panel edge at a joint, (1) said first clip comprising a. a generally L-shaped edge-engaging portion having a first leg of the L inserted into a panel edge and a second leg disposed along the panel edge in a direction inward of said partition assembly, said second leg terminating at the interior face of the panel in a b. stud flange-engageable portion comprising biplanar plates, a first plate disposed along the interior panel face and a second parallel planar plate disposed inwardly of said first plate forming a stud flange-engageable slot therebetween, said first and second plates extending in a direction substantially the same as the first leg of the L-shaped portion, wherein a stud flange is nested within said slot;

(2) said second clip, engaged with a stud and a panel adjacent a panel engaged by a first clip, said second clip comprising a. generally L-shaped edge-engaging portion having a first leg of the L inserted into the panel edge and a second leg disposed along the panel edge in a direction inward of said partition assembly, said second leg terminating at the interior panel face in a b. resilient stud rib-engageable portion comprising a plate disposed along the interior panel face in a direction substantially the same as the first leg of the L-shaped portion, and an integral resilient rib-engaging portion extending from said plate, said resilient portion removably snap-engaged with a stud rib;

whereby panels are demountably engaged to studs by means of a first clip engaged at one vertical edge and a second clip at the opposite vertical edge, wherein the second clip is disengageable by moving a panel outward to disengage the resilient portion from a stud rib, and the first clip, at a joint at the opposite vertical panel edge, is disengageable by sliding the panel sideward to move the slot from nested engagement with a stud flange, and wherein a panel is remountable by reversal of demounting operation.

2. An accessible partition assembly as claimed in claim 1 wherein the studs comprise a C-shaped configuration and said studs are disposed with the openings of the C in substantially the same direction.

3. An accessible partition assembly as claimed in claim 1 wherein the studs comprise a generally Z-shape and said studs are disposed in substantially the same orientation.

4. An accessible partition assembly as claimed in claim 1 wherein the bi-planar plates of the stud flange-engageable portion of the first clip comprises the second plate struck out from said first plate forming the stud flange-engageable slot therebetween.

5. An accessible partition assembly as claimed in claim 1 wherein the resilient stud rib-engageable portion of the second clip comprises an integral resilient rib-engaging portion which is struck out from the first leg inwardly of said first plate for removable snap-engagement with a stud rib.

6. An accessible partition assembly as claimed in claim 1 wherein the stud flange-engageable portion of the first clip comprising said bi-planar plates comprises said second parallel planar plate being folded over the first plate from an edge of the first plate thereby forming the stud flange-engageable slot therebetween.

7. An accessible partition assembly as claimed in claim 1 wherein the resilient stud rib-engageable portion of the second clip comprises said plate having the integral resilient rib-engaging portion extending inwardly from an edge thereof for removable snap-engagement with a stud rib.

8. An accessible partion assembly as claimed in claim 1 wherein the opposite vertical edges of said panels are provided with longitudinal kerfs extending for substantially the full length of the edges and wherein said first leg of the L-shaped portion of the first clip engages within said kerfs and the first leg of the generally L-shaped edge-engaging portion of the second clip engages within said kerfs.

9. An accessible partition assembly as claimed in claim 8 wherein the first leg of the generally L-shaped edge-engaging portion of the first clip includes impaling prongs thereon extending into said kerfing and wherein said first leg of the generally L-shaped edge-engaging portion of the second clip includes impaling prongs thereon inserted into said kerfing.

10. An accessible partition assembly as claimed in claim 1 wherein the opposite vertical edges of said panels are generally flat non-kerfed and wherein the first leg of the L-shaped engaging portion of said first clip includes impaling prongs thereon inserted into panel edges, and the first leg of the L-shaped edge-engaging portion of the second clip includes impaling prongs thereon inserted into panel edges.

11. An accessible partition assembly as claimed in claim 1 wherein the first plate of the stud flange-engageable portion of the first clip includes a barb extending in a direction toward the interior panel face and penetrating the surface of the interior panel face.

12. An accessible partition assembly as claimed in claim 1 wherein the plate of the resilient stud rib-engageable portion of the second clip includes a barb thereon extending in a direction toward the interior face of a panel and penetrating the surface of the interior panel face.

13. An accessible partition assembly as claimed in claim 1 wherein the assembly comprises a multiplicity of said first and second clips being spaced opposingly in pairs along adjacent panels at said joints.

14. An accessible partition assembly as claimed in claim 1 wherein said first and second clips comprise elongate strips extending along panel edges at said joints and wherein said stud flange-engageable portion of said first comprises a plurality of second parallel plate portions, and said resilient stud rib-engageable portion of the second clip comprises a plurality of said integral rib-engaging portions.

15. An accessible partion assembly comprising:

A. two opposed spaced-apart rows of correspondingly opposed pairs of panels, each panel having opposite vertical edges, and interior and exterior panel faces, adjacent panels meeting at joints in edge-to-edge relationship, wherein alternate pairs of opposing corresponding panels are fixedly engaged and pairs of opposing corresponding panels therebetween are demountably engaged whereby fixed panels correspondingly oppose and demountable panels correspondingly oppose;

B. a plurality of generally C-shaped studs located intermediate said rows of panels, and positioned at joints between a pair of adjacent panels, said studs alternately positioned with adjacent studs having openings of the C-shaped disposed in alternate directions, said studs comprising, (1) a web of the C-shape integrally interconnecting, (2) continuous vertical rib portions, (3) a flange extending from each said rib in substantially the same direction and being generally parallel planar with, and adjacent to, opposing interior panel faces; and, C. panel and stud engageable means at each said joint, said engageable means comprising a first and second clip, wherein first clips engage edges of fixed panels and second clips engage edges of removable panels, each clip engaging a stud and one panel at a joint, (1) said first clip comprising a. a generally L-shaped edge-engaging portion having a first leg of the L inserted into the edge of a fixed panel and a second leg disposed along the panel edge in a direction inward of said partition assembly, said second leg terminating at the interior face of a fixed panel in a b. stud flange-engageable portion comprising bi-planar plates, a first plate disposed along the interior panel face and a second parallel planar plate disposed inwardly of said first plate forming a stud flange-engageable slot therebetween, said first and second plates extending in a direction substantially the same as the first leg of the L-shaped portion, wherein a stud flange is nested within said slot;

(2) said second clip engaging a stud and a removable panel adjacent a fixed panel at a joint, said second clip comprising, a. a generally L-shaped edge-engaging portion having a first leg of the L inserted into the edge of a removable panel and a second leg disposed along the panel edge in a direction inward of said partition assembly, said second leg terminating at the interior face of a removable panel in a b. resilient stud rib-engageable portion comprising a plate disposed along the interior panel face in a direction substantially the same as the first leg of the L-shaped portion and an integral resilient rib-engaging portion extending inwardly from said plate, said resilient portion removably snap-engaged with a stud rib;

whereby said fixed panels are engaged along vertical edges at said joints by said fist clips, whereby said removable panels are engaged along vertical edges at said joints by said second clips, thereby alternate pairs of opposing corresponding panels are fixedly engaged and pairs of opposing corresponding panels therebetween are demountably engaged by means of said studs alternately positioned to dispose adjacent studs in opposite directions, whereby the opposite vertical edges of fixed panels are fixedly engaged to stud flanges by said first clips and opposite vertical edges of removable panels are demountably engaged to stud rib portions by said second clips, whereby accessibility is provided along each panel row at said alternate removable panels.

16. An accessible partition assembly as claimed in claim 15 wherein the bi-planar plates of the stud flange-engageable portion of the first clip comprises the second plate struck out from said plate forming the stud flange-engageable slot therebetween.

17. An accessible partition assembly as claimed in claim 15 wherein the resilient stud rib-engageable portion of the second clip comprises an integral resilient rib-engaging portion which is struck out from the first leg inwardly of said first plate for removable snap-engagement with a stud rib.

18. An accessible partition assembly as claimed in claim 15 wherein the stud flange-engageable portion of the first clip comprising said bi-planar plates comprises said second parallel planar plate being folded over the first plate from an edge of the first plate thereby forming the stud flange-engageable slot therebetween.

19. An accessible partition assembly as claimed in claim 15 wherein the resilient stud rib-engageable portion of the second clip comprises said plate having the integral resilient rib-engaging portion extending inwardly from an edge thereof for removable snap engagement with a stud rib.

20. An accessible partition assembly as claimed in claim 15 wherein the opposite vertical edges of said panels are provided with longitudinal kerfs extending for substantially the full length of the edges and wherein said first leg of the L-shaped portion of the first clip engages within said kerfs and the first leg of the generally L-shaped edge-engaging portion of the second clip engages within said kerfs.

21. An accessible partition assembly as claimed in claim 20 wherein the first leg of the generally L-shaped edge-engaging portion of the first clip includes impaling prongs thereon extending into said kerfing and wherein said first leg of the generally L-shaped edge-engaging portion of the second clip includes impaling prongs thereon inserted into said kerfing.

22. An accessible partition assembly as claimed in claim 15 wherein the opposite vertical edges of said panels are generally flat non-kerfed and wherein the first leg of the L-shaped engaging portion of said first clip includes impaling prongs thereon inserted into panel edges, and the first leg of the L-shaped edge-engaging portion of the second clip includes impaling prongs thereon inserted into panel edges.

23. An accessible partition assembly as claimed in claim 15 wherein the first plate of the stud flange-engageable portion of the first clip includes a barb extending in a direction toward the interior panel face and penetrating the surface of the interior panel face.

24. An accessible partition assembly as claimed in claim 15 wherein the plate of the resilient stud rib-engageable portion of the second clip includes a barb extending in a direction toward the interior face of a panel and penetrating the surface of the interior panel face.

25. An accessible partition assembly as claimed in claim 15 wherein the assembly comprises a multiplicity of said first and second clips being spaced opposingly in pairs along adjacent panels at said joints.

26. An accessible partition assembly as claimed in claim 15 wherein said first and second clips comprise elongate strips extending along panel edges at said joints and wherein said stud flange-engageable portion of said first clip comprises a plurality of second parallel plate portions, and said resilient stud rib-engageable portion of the second clip comprises a plurality of said integral rib-engaging portions.

27. An accessible partition assembly comprising:

A. Two opposed spaced-apart rows of correspondingly opposed pairs of panels, each panel having opposite vertical edges, and interior and exterior panel faces, adjacent panels meeting at joints in edge-to-edge relationship, wherein panels along one row are alternately fixedly engaged and demountably engaged, and corresponding opposing panels along the other row are alternately demountably engaged and fixedly engaged, wherein fixed panels oppose corresponding demountable panels;

B. a plurality of generally Z-shaped studs located intermediate said rows of panels and positioned at joints between a pair of adjacent panels, said studs alternately positioned with adjacent studs disposed in 180° rotational relationship with adjacent studs in upside down orientation with respect to one another, said studs comprising, 1. a diagonal web integrally interconnecting,
2. continuous vertical rib portions
3. a flange extending from each said rib in opposite directions and being generally parallel planar with and adjacent to, opposing interior panel faces; and, C. panel and stud engageable means at each said joint, said engageable means comprising a first and second clip, wherein first clips engage edges of fixed panels and second clips engage edges of removable panels, each clip engaging a stud and one panel at a joint, (1) said first clip comprising, a. a generally L-shaped edge-engaging portion having a first leg of the L inserted into the edge of a fixed panel and a second leg disposed along the panel edge in a direction inward of said partition assembly, said second leg terminating at the interior face of a fixed panel in a b. stud flange-engageable portion comprising bi-planar plates, a first plate disposed along the interior panel face and a second parallel planar plate disposed inwardly of said first plate forming a stud flange-engageable slot therebetween, said first and second plates extending in a direction substantially the same as the first leg of the L-shaped portion, wherein a stud flange is nested within said slot;

(2) said second clip engaging a stud and a removable panel adjacent a fixed panel at a joint, said second clip comprising, a. a generally L-shaped edge-engaging portion having a first leg of the L inserted into the edge of a removable panel and a second leg disposed along the panel edge in a direction inward of said partition assembly said second leg terminating at the interior face of a removable panel in a b. resilient stud rib-engageable portion comprising a plate disposed along the interior panel face in a direction substantially the same as the first leg of the L-shaped portion and an integral resilient rib-engaging portion extending inwardly from said plate said resilient portion removably snap-engaged with a stud rib;

whereby said fixed panels are engaged along vertical edges at said joints by said first clips and whereby said removable panels are engaged along vertical edges at said joints by said second clips, thereby panels along one row are alternately fixed and demountable and opposing panels along the other row are alternately correspondingly demountable and fixed, whereby fixed panels oppose corresponding demountable panels by means of said alternately positioned Z-shaped studs studs having adjacent studs in 180° rotational relationship which disposes rib portions along interior panel faces in opposing relation, whereby the opposite vertical edges of fixed panels are fixedly engaged to opposing stud flanges by said first clips and opposite vertical edges of removable panels are demountably engaged to stud rib portions by said second clips, whereby at each pair of corresponding opposing panels, one is removable and the other is fixed permitting accessibility alternately along said partition assembly from one row to the other row.

28. An accessible partition assembly as claimed in claim 27 wherein the bi-planar plates of the stud flange-engageable portion of the first clip comprises the second plate struck out from said first plate forming the stud flange-engageable slot therebetween.

29. An accessible partition assembly as claimed in claim 27 wherein the resilient stud rib-engageable portion of the second clip comprises an integral resilient rib-engaging portion which is struck out from the first leg inwardly of said first plate for removable snap-engagement with a stud rib.

30. An accessible partition assembly as claimed in claim 27 wherein the stud flange-engageable portion of the first clip comprising said bi-planar plates comprises said second parallel planar plate being folded over the first plate from an edge of the first plate thereby forming the stud flange-engageable slot therebetween.

31. An accessible partition assembly as claimed in claim 27 wherein the resilient stud rib-engageable portion of the second clip comprises said plate having the integral resilient rib-engaging portion extending inwardly from an edge thereof for removable snap-engagement with a stud rib.

32. An accessible partition assembly as claimed in claim 27 wherein the opposite vertical edges of said panels are provided with longitudinal kerfs extending for substantially the full length of the edges and wherein said first leg of the L-shaped portion of the first clip engages within said kerfs and the first leg of the generally L-shaped edge-engaging portion of the second clip engages within said kerfs.

33. An accessible partition assembly as claimed in claim 32 wherein the first leg of the generally L-shaped edge-engaging portion of the first clip includes impaling prongs thereon extending into said kerfing and wherein said first leg of the generally L-shaped edge-engaging portion of the second clip includes impaling prongs thereon inserted into said kerfing.

34. An accessible partition assembly as claimed in claim 27 wherein the opposite vertical edges of said panels are generally flat non-kerfed and wherein the first leg of the L-shaped engaging portion of said first clip includes impaling prongs thereon inserted into panel edges, and the first leg of the L-shaped edge-engaging portion of the second clip includes impaling prongs thereon inserted into panel edges.

35. An accessible partition assembly as claimed in claim 27 wherein the first plate of the stud flange-engageable portion of the first clip includes a barb extending in a direction toward the interior panel face and penetrating the surface of the interior panel face.

36. An accessible partition assembly as claimed in claim 27 wherein the plate of the resilient stud rib-engageable portion of the second clip includes a barb extending in a direction toward the interior face of a panel and penetrating the surface of the interior panel face.

37. An accessible partition assembly as claimed in claim 27 wherein the assembly comprises a multiplicity of said first and second clips being spaced opposingly in pairs along adjacent panels at said joints.

38. An accessible partition assembly as claimed in claim 27 wherein said first and second clips comprise elongate strips extending along panel edges at said joints and wherein said stud flange-engageable portion of said first clip comprises a plurality of second parallel plate portions, and said resilient stud rib-engageable portion of the second clip comprises a plurality of said integral rib-engaging portions.

39. An accessible partition assembly comprising:

A. two opposed spaced apart rows of panels each panel having opposite kerfed vertical edges, and interior and exterior panel faces, wherein panels along one row correspondingly oppose panels along the other row between joints, and wherein adjacent panels along each row meet at said joints in edge-to-edge relationship, said joints thereby having four related panels, two adjacent along one row opposing two adjacent along the other row;

B. a plurality of channel-shaped studs located intermediate said rows of panels, and positioned at said joints between pairs of adjacent panels, said studs comprising,
   (1) a web integrally interconnecting,
   (2) continuous vertical rib portions,
   (3) arms extending from each rib in the substantially same direction and being generally planar with and adjacent to, opposing interior panel faces,
   (4) kerf engaging means extending from each said arm and having a generally L-shaped with a first leg extending outwardly between adjacent panel edges and terminating in a second leg extending longitudinal of the panel rows and being inserted into kerfs of opposing panels;

C. resilient panel clips engaging the other two opposing panels at said joints, said clips comprising,
   (1) a generally L-shaped edge-engaging portion having a first leg of L inserted within a panel kerf and a second leg disposed along the panel edge in a direction inward of said partition assembly, said second leg terminating at the interior panel face in a
   (2) resilient stud rib-engaging portion comprising a plate disposed along the interior panel face in a direction substantially the same as the first leg of the L-shaped portion, and an integral resilient rib-engaging portion extending from said plate, said resilient portion removably snap-engaged with a rib of a stud of joint;

whereby demountability is provided at panel edges engaged by said second clip by means of said resilient snap-engagement to a stud rib.

40. An accessible partition assembly as claimed in claim 39 wherein said channel-shaped studs are positioned in the same orientation with said arms extending in substantially the same direction whereby all panels are thereby demountable having one vertical edge engaged by the kerf engaging means of the studs and the opposite vertical kerfed edge demountably engaged to a stud rib portion by means of said resilient clip, whereby said panels are demountable by an outward movement to disengage said clip at one vertical edge and the opposite edge is then disengageable by a sideward sliding movement to remove said panel edge from kerf engagement with said kerf engaging means of the stud, and wherein a panel is remountable by reversal of the demounting operation.

41. An accessible partition assembly as claimed in claim 39 wherein said channel-shaped studs are alternately positioned with arms of adjacent studs disposed in opposite directions, whereby pairs of opposing corresponding panels are alternately demountably and fixedly engaged with said studs wherein fixed pairs of panels have both edges engaged by the kerf engaging means of said studs and wherein demountable panels are engaged to said rib portions of the studs by means of the resilient panel clips engaged along both edges, whereby accessibility is provided along each row at said alternate removable panels.

42. An accessible partition assembly comprising:

A. two opposed space-apart rows of panel, each panel having opposite kerfed vertical dges, and interior and exterior panel faces, wherein panels along one row correspondingly oppose panels along the other row between joints, and wherein adjacent panels along each row meet at said joints in edge-to-edge relationship, said joints thereby having four related panels, two adjacent along one row opposing two adjacent along the other row;

B. a plurality of generally Z-shaped stud located intermediate said rows of panels, and positioned at said joints between pairs of adjacent panels, said studs comprising (1) a diagonal web integrally interconnecting, (2) continuous vertical rib portions, (3) a flange extending from each said rib in opposite directions and being generally parallel planar with, and adjacent to, an interior panel face, (4) kerf engaging means extending from each said flange and having a generally L-shaped with a first leg extending outwardly between adjacent panel edges and terminating in a second leg extending longitudinal of the panel rows, said second legs extending in opposite directions and being inserted into edge kerfs of two panels on opposing rows at opposite sides of the joint; and C. resilient panel clips engaging the other two panels on opposing rows at opposite sides of the joint, said clips comprising, (1) a generally L-shaped edge-engaging portion having a first leg of the L inserted within a panel kerf and a second leg disposed along the panel edge in a direction inward of said partition assembly, said second leg terminating at the interior panel face in a (2) resilient stud rib-engaging portion comprising a plate disposed along the interior panel face in a direction substantially the same as the first leg of the L-shaped portion, and an integral resilient rib-engaging engaging portion extending from said plate, said resilient portion removably snap-engaged with a rib of a stud at a joint;

whereby demountability is provided at panel edges engaged by said clip by means of said resilient snap-engagement to a stud rib.

43. An accessible partition assembly as claimed in claim 42 wherein said Z-shaped studs are positioned in the same orientation with said second legs of the kerf engaging means of said studs extending in substantially the same direction along one row and substantially the same opposite direction along the opposing row, whereby all panels are thereby demountable having one vertical edge engaged by the kerf engaging means of a stud and the opposite vertical kerfed edge demountably engaged to a stud rib portion by means of said resilient clips, whereby said panels are demountable by an outward movement to disengage said clip at one vertical edge and the opposite edge is then disengageable by a sideward sliding movement to remove said panel edge from kerf engagement with said kerf engaging means of said stud, and wherein a panel is remountable by reversal of the demounting operation.

44. An accessible partition assembly as claimed in claim 42 wherein said Z-shaped studs are alternately positioned with adjacent studs disposed in 180° rotational relationship with adjacent studs in upside down orientation with respect to one another, whereby panels along one row are alternately fixedly engaged and demountably engaged, and corresponding opposing panels along the other row are alternately demountable engaged, wherein fixed panels oppose corresponding demountable panel, wherein the opposite vertical edges of fixed panels are fixedly engaged to said studs by said kerf engaging means of the studs and the opposite vertical edges of opposing corresponding removable panels are demountably engaged to said studs by said resilient clip means, thereby at each pair of corresponding opposing panels, one is removable and the other fixed permitting accessibility alternately along said partition assembly from one row to the other row.

* * * * *

UNITED STATES PATENT AND TRADEMARK OFFICE

CERTIFICATE OF CORRECTION

PATENT NO. : 4,255,910

DATED : March 17, 1981

INVENTOR(S) : Alan C. Wendt

It is certified that error appears in the above—identified patent and that said Letters Patent is hereby corrected as shown below:

In the Claims:

In Claim 16, at line 47, after the word "said" and before the word "plate" insert --first--.

Signed and Sealed this

*Eighteenth* Day of *August 1981*

[SEAL]

*Attest:*

GERALD J. MOSSINGHOFF

*Attesting Officer*

*Commissioner of Patents and Trademarks*